US011480324B2

(12) United States Patent
Secretin

(10) Patent No.: US 11,480,324 B2
(45) Date of Patent: Oct. 25, 2022

(54) CONTROLLABLE MODULAR LUMINAIRE DRIVER

(71) Applicant: SCHREDER S.A., Brussels (BE)

(72) Inventor: Laurent Secretin, Remicourt (BE)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 17/279,809

(22) PCT Filed: Sep. 25, 2019

(86) PCT No.: PCT/EP2019/075916
§ 371 (c)(1),
(2) Date: Mar. 25, 2021

(87) PCT Pub. No.: WO2020/064864
PCT Pub. Date: Apr. 2, 2020

(65) Prior Publication Data

US 2022/0034496 A1 Feb. 3, 2022

(30) Foreign Application Priority Data

Sep. 25, 2018 (NL) ..... 2021707

(51) Int. Cl.
*F21V 23/00* (2015.01)
*F21V 23/06* (2006.01)

(52) U.S. Cl.
CPC ..... *F21V 23/008* (2013.01); *F21V 23/06* (2013.01)

(58) Field of Classification Search
CPC ..... F21V 23/008; F21V 23/06
See application file for complete search history.

(56) References Cited

U.S. PATENT DOCUMENTS 5,416,384 A * 5/1995 Bavaro ..... H05B 47/11 315/86
9,599,326 B2 * 3/2017 Hanke ..... F21K 9/20
(Continued)

FOREIGN PATENT DOCUMENTS

GB 2524664 A 9/2015
WO 2014073913 A1 5/2014

OTHER PUBLICATIONS

PCT International Search Report and Written Opinion, PCT Application No. PCT/EP2019/075916, mailed Oct. 30, 2019, 12 pages.

*Primary Examiner* — Evan P Dzierzynski
(74) *Attorney, Agent, or Firm* — McDonnell Boehnen Hulbert & Berghoff LLP

(57) ABSTRACT

Example embodiments relate to controllable modular luminaire drivers. One embodiment includes a luminaire driver. The luminaire driver includes a driver housing provided with input connector elements for connection to a power supply and output connector elements for connection to at least one light source. The input connector elements and output connector elements being accessible from outside of the driver housing. The luminaire driver also includes a driver circuitry in the driver housing between the input connector elements and the output connector elements, and configured to perform a driver function of the at least one light source. Additionally, the luminaire driver includes a receiving means configured for receiving at least one pluggable module. The at least one pluggable module includes a first circuitry associated with a first protocol and a second circuitry associated with a second protocol. The second protocol being different from the first protocol.

21 Claims, 5 Drawing Sheets

(56) References Cited

U.S. PATENT DOCUMENTS

| | | | | |
|---|---|---|---|---|
| 9,648,678 | B1 * | 5/2017 | Xiong | H05B 45/3725 |
| 2013/0248244 | A1 * | 9/2013 | Pizzi | H01R 9/2633<br>174/541 |
| 2014/0159583 | A1 * | 6/2014 | Bollmann | H05B 45/3725<br>315/113 |
| 2015/0323169 | A1 * | 11/2015 | Kuriyama | F21V 19/002<br>362/294 |
| 2016/0073455 | A1 * | 3/2016 | Takacs | H05B 45/3725<br>315/201 |
| 2016/0374168 | A1 * | 12/2016 | Ackmann | H05B 45/14 |
| 2017/0188438 | A1 | 6/2017 | Vollmer et al. | |
| 2017/0279300 | A1 * | 9/2017 | Catalano | H02J 9/061 |

* cited by examiner

CONTROLLABLE MODULAR LUMINAIRE DRIVER

CROSS-REFERENCE TO RELATED APPLICATIONS

The present application is a national stage entry of PCT/EP2019/075916 filed Sep. 25, 2019, which claims priority to NL 2021707 filed Sep. 25, 2018, the contents of each of which are hereby incorporated by reference.

FIELD OF INVENTION

The invention relates to luminaire drivers, and more in particular to controllable modular luminaire drivers.

BACKGROUND

State-of-the-art luminaire drivers today provide much more functionality than a basic/primary function providing ordinary on-off driving signals suitable in terms of voltage and/or current for its target light emitting devices (e.g. one or more LEDs). In essence the drivers are today designed to provide a plurality of functionalities and/or are made capable to operate for a plurality of target devices. Unfortunately this evolution results in too bulky and/or costly drivers.

The described capabilities of the state-of-the-art drivers are realized by providing as part of said drivers' architecture a plurality of circuits, typically each matched with a certain (even partly overlapping) functionality, such that when electing a certain use of the drivers (e.g. for a certain target device and a certain mode of operation) most of the other circuits remain available although they are not used. Hence the bulkiness and cost of the drivers do in practice not result in efficient use either.

Besides the fact that a model of driver might be significantly oversized relative to market need, further drawbacks regarding the state-of-the-art drivers are as follows. Different drivers using different connections means that electrical/mechanical integration within the luminaire has to be worked out for each of them. Different drivers use different electronic circuits, hence electrical/thermal performances related to the basic/primary function have to be evaluated for each of them. Different drivers use different electronic circuits, hence a certification process (electrical safety/standards compliance) has to be applied for each of them.

SUMMARY

It is an object of embodiments of the invention to retain the advantages of the state-of-the art drivers in terms of their enhanced functionality and/or suitability for a large class of light emitting devices and control devices while avoiding or reducing the above described problems. More particularly embodiments of the invention enable to further enhance the functionalities and/or broaden the suitability by alleviating the identified size and/or cost barrier, and preferably also overcome other drawbacks of the state of the art.

According to a first aspect of the invention, there is provided a luminaire driver comprising a driver housing, a driver circuitry, and a receiving means. The driver housing is provided with input connector elements for connection to a power supply, output connector elements for connection to at least one light source, and at least one first and second control connector element. The driver circuitry is arranged in said driver housing between said input connector elements and said output connector elements, and is configured to perform a driving function of the at least one light source. The receiving means is configured for receiving at least one pluggable module comprising a first circuitry associated with a first protocol and a second circuitry associated with a second protocol, said second protocol being different from said first protocol. The receiving means is configured such that the at least one pluggable module can be received from outside of the driver housing. The receiving means is configured such that at least one of the first circuitry and the second circuitry is connected to the driver circuitry when the at least one pluggable module is plugged in the receiving means. The at least one first and second control connector element are connected to the first and second circuitry, respectively, when the at least one pluggable module is plugged in the receiving means. The at least one first and second control connector element are arranged such that they are accessible by a user from outside of the driver housing.

By providing at least one pluggable module with a first circuitry associated with a first protocol and a second circuitry associated with a second protocol, said second protocol being different from said first protocol, the driver is given additional functionalities in a modular way. The at least one first and second control connector element are connected to the first and second circuitry, respectively, when the at least one pluggable module is plugged in the receiving means, such that input and/or output control signals can be sent and/or received to/from the first and second circuitry. First input and/or output signals can be sent and/or received to/from the first circuitry using the first protocol, allowing the at least one first control connector element to be connected to a first device of the luminaire, e.g. a first communication or sensor device, which is capable of communicating through the first protocol. Similarly, second input and/or output signals can be sent and/or received to/from the second circuitry using the second protocol, allowing the at least one second control connector element to be connected to another second device of the luminaire, e.g. a second communication or sensor device, which is capable of communicating through the second protocol. In other words, the at least one pluggable module can be selected in function of the first and second devices present in the luminaire, which need to exchange data with the driver (i.e. send data to and/or receive data from the driver), and the driver can be extended with the required functionalities in a very convenient manner using the selected at least one pluggable module, without the need for redesigning the driver.

The input connector elements, the output connector elements, and the first and second control connector elements are accessible from the outside of the driver housing. The driver housing has a plurality of walls, and the input connector elements, the output connector elements, and the first and second control connector elements are provided at or in the plurality of walls of the driver housing, such that those connector elements are available at the outside of the driver housing for being connected to the respective components. In other words, the luminaire driver forms a main component to which many other components can be connected: the input connector elements can be connected to the power supply, the output connector elements can be connected to the at least one light source, the first and second control connector elements can be connected to a device such as a sensor or communication device.

Preferably, the first and the second circuitry are included in a single pluggable module. In that way certain components of the pluggable module may be used in common by the first and second circuitry. However, it is also possible to include the first circuitry in a first pluggable module, and to include the second circuitry in a second different pluggable module.

The receiving means may be configured such that both the first circuitry and the second circuitry are directly or indirectly connected to the driver circuitry when the at least one pluggable module is plugged in the receiving means. However, it is also possible that e.g. only the first circuitry is connected to the driver circuitry, and that the second circuitry is connected to the first circuitry.

Preferably, the receiving means is configured such that the first circuitry and the second circuitry can be used independently, such that signaling using the first protocol and signaling using the second protocol can take place independently of each other, and optionally simultaneously. For example, the driver circuitry may be controlled at the same time using data received from a communication module which is connected to the at least one first control connector element and which communicates using the first protocol, and using data received from a sensor device which is connected to the at least one second control connector element and which communicates using the second protocol.

The driver circuitry may be configured to drive not only the at least one light source, but may also be configured to drive other components of a luminaire. The receiving means may then be configured such that the first circuitry and/or the second circuitry are/is directly or indirectly connected to a portion of the driver circuitry configured to drive one or more other components of a luminaire, such as a camera, a sensor, etc.

According to a preferred embodiment, the receiving means is at least partly situated in the driver housing and/or is part of the driver housing. For example, the driver housing may be provided with a recess for receiving the at least one pluggable module, said recess forming a portion of the receiving means.

According to a preferred embodiment, the receiving means and the at least one pluggable module are configured such that the at least one pluggable module is removable. In that manner the pluggable module may be easily removed and changed for another pluggable module, e.g. when the communication and/or sensor devices to communicate with have changed.

According to a preferred embodiment, the at least one first control connector element comprises at least a first input control connector element and a first output control connector element, and the at least one second control connector element comprises a second input and/or output control connector element, preferably a second input and output control connector element. By providing both an input and an output connector element for a circuitry associated with a protocol, it is made possible to send and receive data in an easy manner using the input and output connector element. If the protocol is only used for sending data or only used for receiving data, only one of the input and output connector element may be used.

According to a preferred embodiment, the driver circuitry is provided on a circuit board in the driver housing. Preferably, the receiving means comprises a slot provided on said circuit board, said slot being configured to receive a part of a circuit board with the first and second circuitry of the pluggable module. The recess may be provided in a surface of the driver housing opposite the slot. Such a configuration results in a compact driver in which the required connections between the first and second circuitry and the driver circuitry can be easily realized. In another possible embodiment, the driver housing may be provided with a door, and the receiving means may be arranged inside the driver housing. The pluggable module can be installed by opening the door, inserting the pluggable module in the receiving means, and closing the door.

According to a preferred embodiment, the driver circuitry comprises voltage-to-current converter circuitry configured for generating a drive current for the at least one light source. Such converter circuitry is preferred when the light module comprises light emitting diodes. In that manner, a plurality of light emitting diodes connected in series can be easily provided with a drive current. In alternative embodiments, a voltage-to-voltage converter circuitry may be used.

According to an exemplary embodiment, the driver circuitry comprises control circuitry configured for controlling the converter circuitry in function of a control signal received through the first and/or second control connector element. For example, a first control signal may be received through the first control connector element using the first protocol, e.g. a dimming protocol, and the control circuitry may control the converter circuitry, and typically a switching component of the converter circuitry, to adjust the drive signal at the output connector elements accordingly. For example, a second control signal may be received through the second control connector element using the second protocol, e.g. a communication protocol used by a sensor of the luminaire, and the control circuitry may control the converter circuitry, and typically a switching component of the converter circuitry, to adjust the drive signal at the output connector elements according to the communicated data received through the second control connector element.

According to a preferred embodiment, the first and/or second circuitry comprises digital signal processing circuitry. This may be useful if the data received through the first and/or second control connector element needs to be further processed into a suitable control signal for controlling the driver circuitry, and/or if data obtained from the driver circuitry needs to be processed before sending it out through the first and/or second control connector element. By way of example a pluggable module may be equipped with a microprocessor being capable of analyzing pictures received from a camera of the luminaire through the at least one first or second control connector element.

According to a preferred embodiment, the first and/or second circuitry comprises sensor control circuitry, preferably any one of the following: IR camera daylight sensing circuitry, motion sensor and video/image processing circuitry, air quality sensing circuitry, sound sensing circuitry.

According to a preferred embodiment, the luminaire driver further comprises internal circuitry configured to recognize the presence and/or the type of a pluggable module when the pluggable module is plugged-in in the receiving means. The type of the module might be a simple identification number, but it could also be a more in depth definition of the functionality of the module. In particular, the type of the module gives information on the functionalities of the pluggable module. Recognition can be based e.g. on voltage or current level signals. The luminaire driver may then further comprise signal switching and/or signal adaption circuitry. The internal circuitry may be configured to set the signal switching and/or signal adaption circuitry in function of the recognized type. In other words, after recognizing the type of module, the driver is capable of at least taking the steps to set the right signal switching, in particular for enabling the use of the plugged-in module functionalities. In an alternative embodiment, the pluggable module is adapted to generate either a recognition signal and/or to perform the right signal switching itself. A recognition signal can be provided through a certain voltage or current.

According to a preferred embodiment, the first circuitry is configured to perform a dimming control function for dimming the at least one light source based on signals received using the first protocol. The second circuitry is configured to perform a communication function using the second protocol.

The driver may be configured to allow the use of the first and second circuitry simultaneously, e.g. by using a data bus, preferably SPI or $I^2C$, or separate data connections between the first and second circuitry, on the one hand, and the driver circuitry, on the other hand.

The first and/or second protocol may comprise any one or more of the following: Communication Area Network (CAN), Digital Addressable Lighting Interface (DALI), Universal Asynchronous Receiver-Transmitter (UART), 1-10V, I2C, RS485, USB, Ethernet, Local Interconnect Network (LIN), an analogue communication protocol such as an analog 4-20 mA current loop protocol used for electronic signaling. It is also possible to use a wireless protocol, such as EnOcean, Bluetooth Low Energy (BLE), ZigBee control, NFC (Near Field Communication), Sigfox, Narrow-Band Internet of Things (NB-IoT), LoRaWAN, Li-Fi control, Low-Power Wide-Area Network (LPWAN), but this is generally not preferred. Typically a suitable protocol will be chosen depending on the amount of data that needs to be transferred and/or on the required functionalities. The pluggable module may be capable of creating control signals for the control bus of the driver circuitry if the driver circuitry comprises a control bus. Alternatively, the plugged-in module can provide a bus functionality to the driver circuitry.

According to a preferred embodiment, the receiving means comprises a mechanical means comprising a biunique fitting mechanism configured to hold the pluggable module. This may help to avoid misuse of the driver and the circuitry of the pluggable module.

According to a preferred embodiment, the input connector elements and/or the output connector elements and/or the first and second control connector element are any one of the following: a connection wire, a connector plug, a connector pin, a connector socket, a terminal block, or any combination thereof.

Preferably, the receiving means comprises electronic means adapted to transfer power to the first and second circuitry. The electronic means can also include a means to identify the first and second circuitry, e.g. by way of a voltage level or signal received on one of the connections between the first and second circuitry and the receiving means. Those means for automatic module identification may comprise a resistor arranged so that its voltage level is related to the type of first and second circuitry. Alternatively, a capacitor or a RFID chip or other chips and tags may be used to receive information specific to the first and second circuitry. Alternatively or additionally, the electronic means may be provided as data or signal adaptation means, e.g. amplification means, in order to bring signals from the first and second circuitry within the limits necessary for the driver circuitry. Also, the electronic means may comprise intelligence e.g. a micro-processing unit. In that way more advanced installations can still be based on the same cost efficient driver being equipped with the at least one pluggable module comprising the desired functionalities. Alternatively or additionally, data or signal adaptation means may be provided in the pluggable module instead of in the receiving means. Also, it is to be noted, that next to or instead of means for signal adaption there may exist means for electrical protection or electrical insulation on the driver or the module side.

According to a further embodiment, a single pluggable module may comprise circuitry associated with three or more different protocols instead of two different protocols.

According to a further developed embodiment the driver may comprise one or more additional receiving means for one or more additional pluggable modules with circuitry. Also, in another embodiment the receiving means may include space or slots to accommodate two pluggable modules. In yet another embodiment the receiving means is configured to receive a stack of pluggable modules. The driver may be designed to allow the use of two or more pluggable modules simultaneously, e.g. by using a data bus, preferably SPI or $I^2C$, or separate data connections between the circuitry in the pluggable modules and the driver circuitry.

According to a preferred embodiment, the luminaire driver comprises at least one pluggable module plugged in the receiving means.

According to a second aspect of the invention, there is provided a luminaire comprising a luminaire driver according to any one of the preceding embodiments.

According to a third aspect of the invention, there is provided a pluggable module configured for use in a luminaire driver according to any one of the preceding embodiments. The pluggable module comprises a first circuitry associated with a first protocol and a second circuitry associated with a second protocol, said second protocol being different from said first protocol. According to yet another aspect of the invention, there is provided a use of a pluggable module in a luminaire driver according to any one of the embodiments above.

One or more features of the above or below described embodiments may be combined with features of the independent claims to a new embodiment of the invention.

BRIEF DESCRIPTION OF THE FIGURES

The accompanying drawings are used to illustrate presently preferred non-limiting exemplary embodiments of luminaire drivers and systems of the present invention. The above and other advantages of the features and objects of the invention will become more apparent and the invention will be better understood from the following detailed description when read in conjunction with the accompanying drawings, in which.

DESCRIPTION OF EMBODIMENTS

Figure 1:
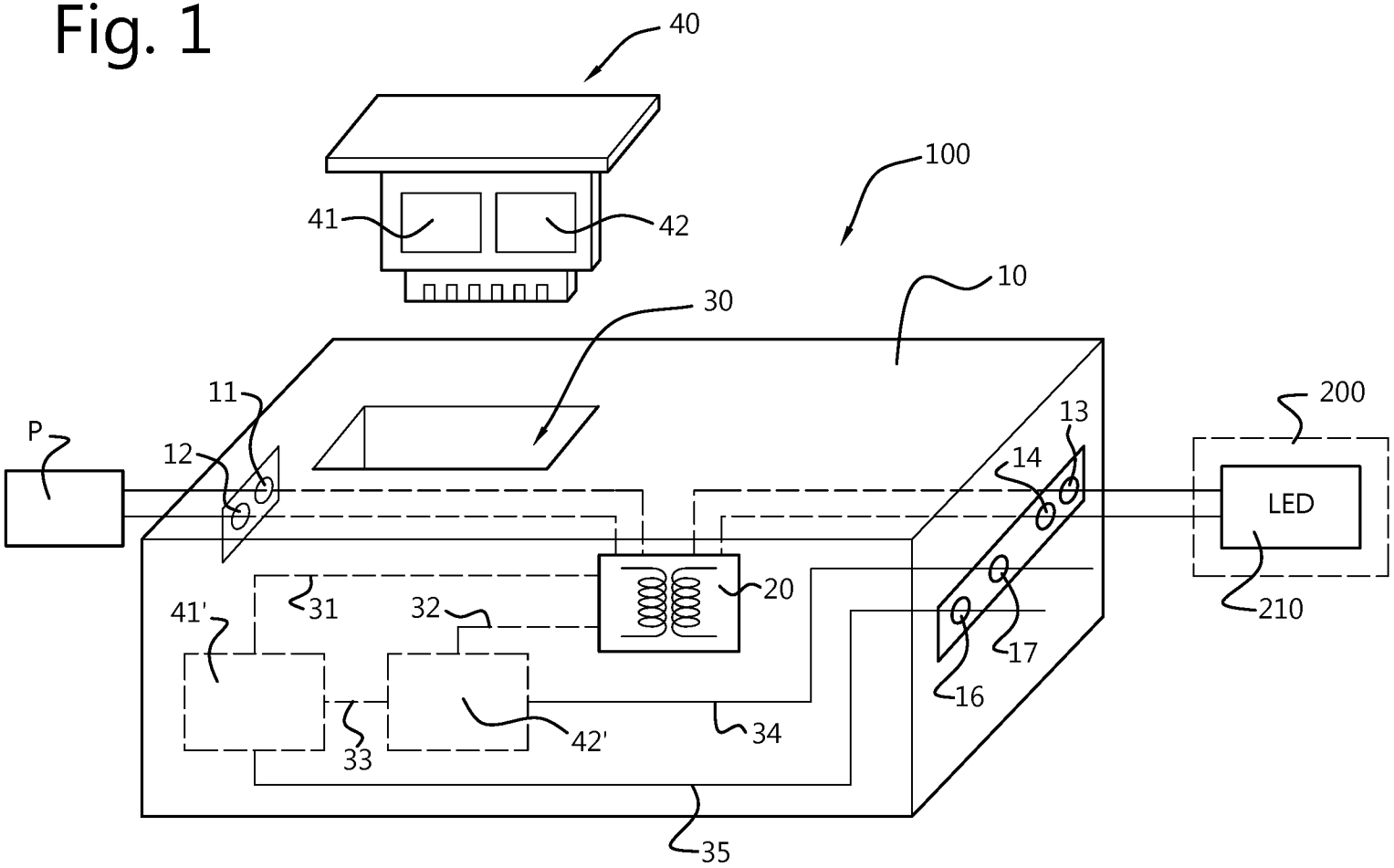
FIG. 1 schematically illustrates a perspective view of an exemplary embodiment of a luminaire driver and a pluggable module for use in a luminaire driver.

FIG. 1 schematically illustrates a perspective view of an exemplary embodiment of a luminaire driver 100 and a pluggable module 40 for use in the luminaire driver 100. The luminaire driver 100 comprises a driver housing 10, a driver circuitry 20, and a receiving means 30. The driver housing 10 is provided with input connector elements 11, 12 for connection to a power supply P, with output connector elements 13, 14 for connection to at least one light source 210 of a light module 200, and with a first and second control connector element 16, 17. It should be clear for the skilled person that in other embodiments the number of control connector elements may vary, but at least one first and second control connector element 16, 17 is present. The at least one light source 210 may comprise a plurality of light emitting diodes (LED). The input connector elements 11, 12 and/or the output connector elements 13, 14 and/or the first and second control connector elements 16, 17 may be any one of the following: a connection wire, a connector plug, a connector pin, a connector socket, a terminal block, or any combination thereof. The driver circuitry 20 is arranged in said driver housing 10 between said input connector elements 11, 12 and said output connector elements 13, 14. The driver circuitry 20 is configured to perform a driving function of the at least one light source 210.

The luminaire driver 100 may be used in a luminaire system comprising a luminaire head with a luminaire housing and optionally a luminaire pole. The luminaire head may be connected in any manner known to the skilled person to the luminaire pole. Typical examples of such systems are street lights. In other embodiments, a luminaire head may be connected to a wall or a surface, e.g. for illuminating buildings or tunnels. The light module 200 may be arranged in the luminaire housing of the luminaire head. Typically, the light module 200 comprises a plurality of light sources 210, e.g. a plurality of light emitting diodes, preferably mounted on a carrier such as a PCB. The luminaire driver 100 may be provided in or on the luminaire head, or in or on a luminaire pole, and more generally anywhere in the luminaire system.

The receiving means 30 is configured for receiving a pluggable module 40 comprising a first circuitry 41 associated with a first protocol and a second circuitry 42 associated with a second protocol, said second protocol being different from said first protocol. The first and/or second protocol may comprise any one of the following: CAN, DALI, UART, 1-10V, 0-10V, I2C, RS485, ENOCEAN, Bluetooth Low Energy (BLE), ZigBee control, NFC (Near Field Communication), Low-Power Wide-Area Network (LPWAN), Sigfox, Narrow-Band Internet of Things (NB-IoT), LoRaWAN. Optionally, the first and/or second circuitry 41, 42 may comprise digital signal processing circuitry. Additionally or alternatively, the receiving means 30 may comprise digital signal processing circuitry. In addition, the first and/or second circuitry 41, 42 may comprise sensor control circuitry. Preferably, sensor control circuitry may be any one of the following: IR camera daylight sensing circuitry, motion sensor and video/image processing circuitry, air quality sensing circuitry, sound sensing circuitry. In an exemplary embodiment, the first circuitry 41 may be configured to perform a dimming control function for dimming the at least one light source 210, and the second circuitry 42 may be configured to perform a communication function. In another exemplary embodiment, the first circuitry 41 may be configured to perform a dimming control function for dimming the at least one light source 210 using the first protocol, e.g. DALI, and the second circuitry 42 may be configured to perform a dimming control function for dimming the at least one light source 210 using the second protocol, e.g. 1-10V or 0-10V. In yet another exemplary embodiment, the first circuitry 41 may be configured to receive first control signals from a peripheral device of the luminaire, such as a camera using a first protocol, and the second circuitry 42 may be configured to send second control signals using a second protocol, e.g. DALI (e.g. second control signals indicating whether a parking space is free or not based on the received first control signals) to another peripheral communication device of the luminaire. The other peripheral communication device may be e.g. a communication device capable of communicating with remote devices using 4G.

In the illustrated embodiment, the receiving means 30 is integrated in the driver housing 10. The driver housing 10 is provided with a recess for receiving the pluggable module 40, said recess forming a portion of the receiving means 30. In other embodiments, the receiving means 30 may be only partly situated in the driver housing 10, or may not be part of the driver housing 10. For example, the receiving means could also have a separate housing mounted on the driver housing. The receiving means 30 is configured such that the pluggable module 40 can be received from outside of the driver housing 10. The receiving means 30 may comprise a mechanical means comprising a biunique fitting mechanism configured to hold the pluggable module 40. In addition, the receiving means 30 and the pluggable module 40 may be configured such that the pluggable module 40 is removable.

In the embodiment illustrated in FIG. 1, when the pluggable module 40 is plugged in the receiving means 30 the first circuitry 41 (indicated with reference numeral 41' in the plugged-in position) and the second circuitry 42 (indicated with reference numeral 42' in the plugged-in position) are connected to the driver circuitry 20. It should be clear for the skilled person that in other embodiments only one of the first circuitry 41' and the second circuitry 42' may be connected to the driver circuitry 20, but at least one of the first circuitry 41' and the second circuitry 42' is connected to the driver circuitry 20. For example, in other embodiments the first circuitry 41' may be connected to the second circuitry 42'. In other words, the receiving means 30 may be configured such that both the first circuitry 41' and the second circuitry 42' are directly or indirectly connected to the driver circuitry 20, when the pluggable module 40 is plugged in the receiving means, or so that e.g. only the first circuitry 41' is connected to the driver circuitry 20, and that the second circuitry 42' is connected to the first circuitry 41'. It is noted that the first connection 31 between the first circuitry 41' and the driver circuitry 20 may comprise at least one power line and/or at least one control line and/or at least one line capable of transmitting both power and control data. Similarly, the second connection 32 between the second circuitry 42' and the driver circuitry 20 may comprise at least one power line and/or at least one control line and/or at least one line capable of transmitting both power and control data. The connection 33 between the first circuitry 41' and the second circuitry 42' may also comprise at least one power line and/or at least one control line and/or at least one line capable of transmitting both power and control data. In such an embodiment, the driver circuitry 20 may be further configured for providing a suitable supply voltage and/or current to the first and/or second circuitry 41, 42. Alternatively or in addition, the pluggable module 40 may be provided with a battery.

In addition, when the pluggable module 40 is plugged in the receiving means 30 the first and second control connector elements 16, 17 are connected to the first and second circuitry 41', 42', respectively. It should be clear for the skilled person that in other embodiments two or more first control connector elements 16 may be connected to the first circuitry 41', and two or more second control connector elements 17 may be connected to the second circuitry 42' when the pluggable module 40 is plugged in the receiving means 30 (see also FIG. 2). The first and second control connector elements 16, 17 are arranged such that they are accessible by a user from outside of the driver housing 10. The lines 34, 35 connecting the first and second control connector elements 16, 17 to the first and second circuitry 41, 42 may comprise a unidirectional or a bidirectional data control line.

The luminaire driver 100 may further comprise internal circuitry (not shown) configured to recognize the presence and/or the type of the pluggable module 40 when the pluggable module 40 is plugged-in in the receiving means 30. In such case, the luminaire driver 100 may further comprise signal switching and/or signal adaption circuitry (not shown) between the first and second circuitry 41', 42' and the driver circuitry 20, and/or between the one or more first and second control connector elements 16, 17 and the first and second circuitry 41', 42'. The internal circuitry may be configured to set the signal switching and/or signal adaption circuitry in function of the recognized type of pluggable module 40.

In the example of FIG. 1, the first and second circuitry 41, 42 are provided in the same pluggable module 40. However, it is also possible to provide a first pluggable module with the first circuitry and a second pluggable module with the second circuitry, wherein the other elements of the driver may be as illustrated in FIG. 1.

Figure 2:
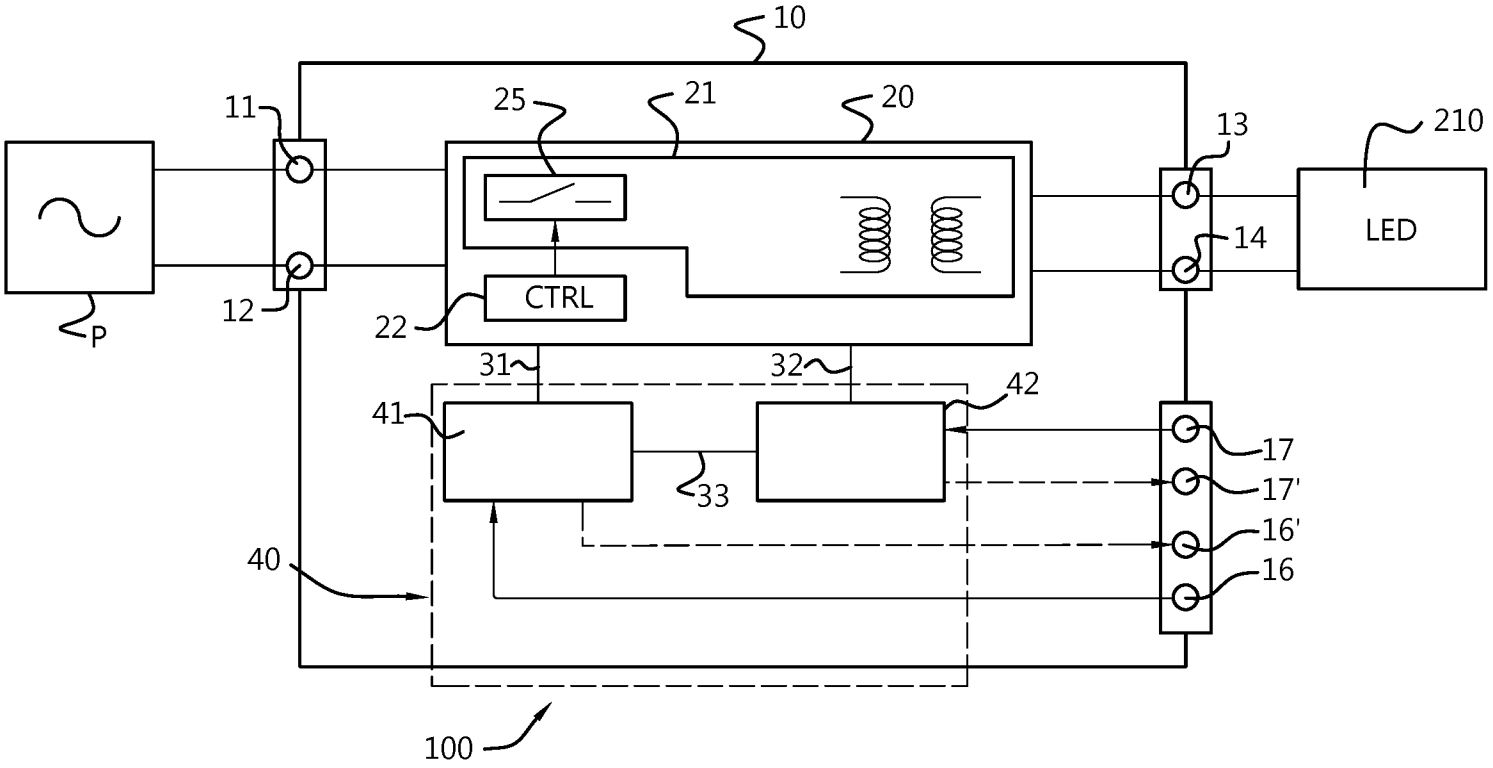
FIG. 2 schematically illustrates an exemplary embodiment of a luminaire driver and a pluggable module plugged in the receiving means thereof.

FIG. 2 schematically illustrates an exemplary embodiment of a luminaire driver 100 and a pluggable module 40 plugged in the receiving means (not shown) thereof. The luminaire driver 100 comprises a driver housing 10, a driver circuitry 20, a receiving means (not shown). The driver housing 10 is provided with input connector elements 11, 12 for connection to a power supply P, with output connector elements 13, 14 for connection to at least one light source 210, with two first control connector elements 16, 16', and two second control connector elements 17, 17'. One of the two first control connector elements 16, 16' may correspond to a first input control connector element 16, and the other one may correspond to a first output control connector element 16'. In addition, one of the two second control connector elements 17, 17' may correspond to a second input control connector element 17, and the other one may correspond to a second output control connector element 17'. In other embodiments, two or more first input control connector elements and/or two or more first output connector elements may be provided. Similarly, two or more second input control connector elements and/or two or more second output connector elements may be provided. The input connector elements 11, 12 and/or the output connector elements 13, 14 and/or the first and second control connector elements 16, 16', 17, 17' may be any one of the following: a connection wire, a connector plug, a connector pin, a connector socket, a terminal block, or any combination thereof. The driver circuitry 20 is arranged in the driver housing 10 between the input connector elements 11, 12 and the output connector elements 13, 14. The driver circuitry 20 may comprise a converter circuitry 21, and in particular a voltage-to-current converter circuitry configured for generating a drive current for the at least one light source 210. The driver circuitry 20 may also comprise control circuitry 22 configured for controlling the converter circuitry 21, and in particular a switching element 25 of the converter circuitry 21, in function of a signal received through the first control connector elements 16, 16' and/or the second control connector elements 17, 17'. The control circuitry 22 may also include processing means and memory that can be used to further process and/or store data received/transmitted through the first and/or second circuitry 41, 42. The connections 31, 32, 33 may be as described above in connection with FIG. 1.

The pluggable module 40 comprises a first circuitry 41 associated with a first protocol and a second circuitry 42 associated with a second protocol, said second protocol being different from said first protocol. The first circuitry 41 and the second circuitry 42 are connected to the driver circuitry 20. In addition, the two first control connector elements 16, 16' are connected to the first circuitry 41, and the two second control connector elements 17, 17' are connected to the second circuitry 42. By providing the pluggable module 40 with the first and second circuitry 41, 42, the driver 100 is given additional functionalities in a modular manner. The at least one first and second control connector element 16, 16', 17, 17' are connected to the first and second circuitry 41, 42, respectively, when the pluggable module is plugged in the receiving means, such that input and/or output control signals can be sent and/or received to/from the first and second circuitry 41, 42. First input and/or output signals can be sent and/or received to the first circuitry 41 using the first protocol. At least one first control connector element 16, 16' may be connected to a first device, e.g. a first communication or sensor device, which is capable of communicating through the first protocol. Similarly, second input and/or output signals can be sent and/or received to the second circuitry 42 using the second protocol, and at least one second control connector element 17, 17' may be connected to a second device, e.g. a second communication or sensor device, which is capable of communicating through the second protocol. In other words, the pluggable module can be selected in function of the first and second devices present in the luminaire, which need to exchange data with the driver (i.e. send data to and/or receive data from the driver), and the driver can be extended with the required functionalities in a very convenient manner using the selected pluggable module, without the need for redesigning the driver.

Figure 3A:
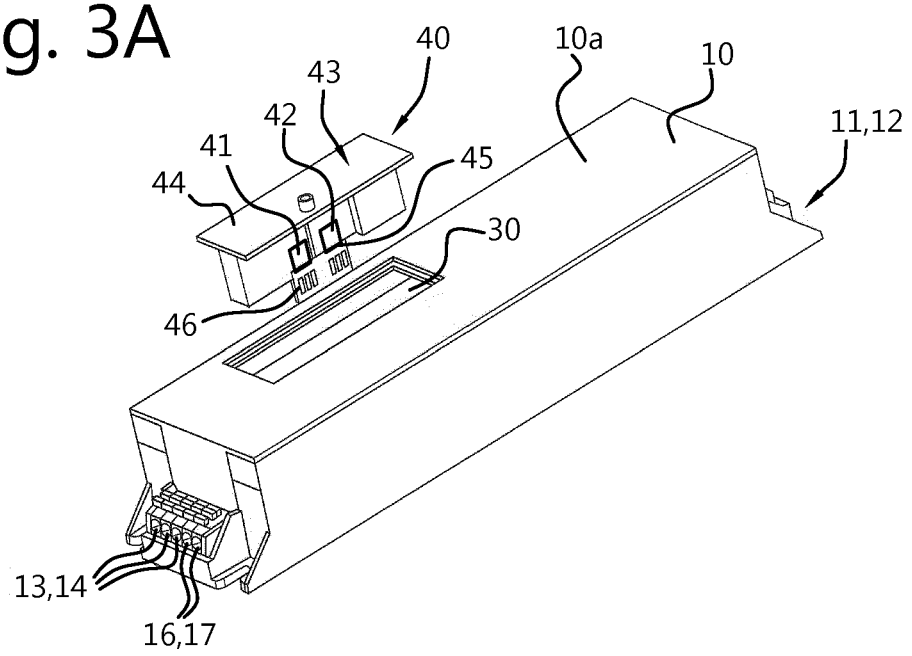
FIGS. 3A and 3B respectively illustrate a perspective view and a cross-sectional view of an exemplary embodiment of a luminaire driver and a pluggable module for use in a luminaire driver.
Figure 3B:
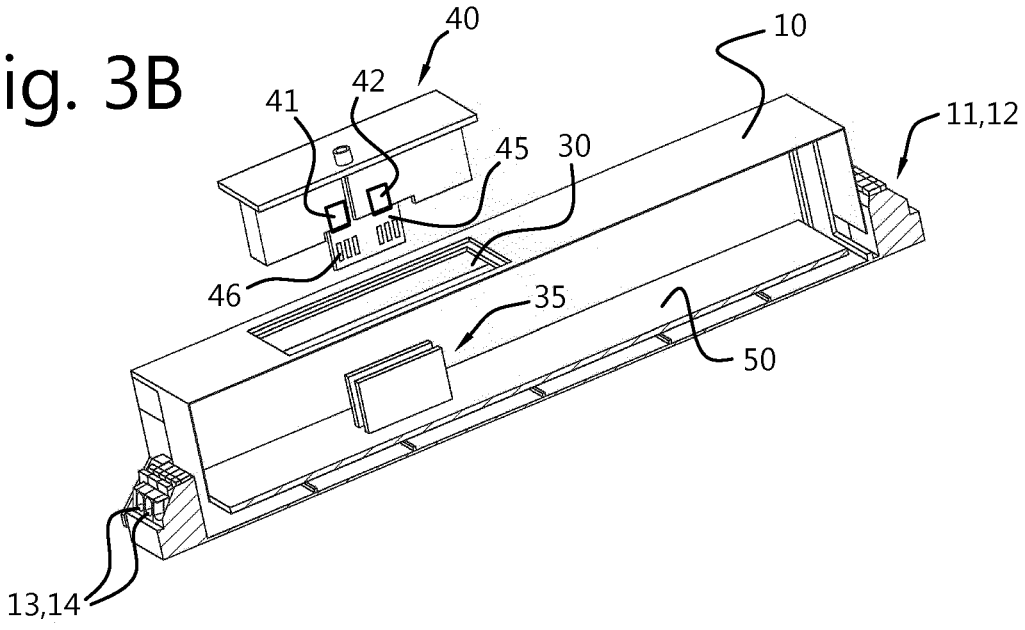

FIGS. 3A and 3B respectively illustrate a perspective view and a cross-sectional view of an exemplary embodiment of a luminaire driver and a pluggable module for use in a luminaire driver. In the embodiment of FIG. 3A, the receiving means 30 is situated in the driver housing 10 and is part of the driver housing 10. The driver housing 10 is provided with a recess for receiving the pluggable module 40, said recess forming a portion of the receiving means 30. The recess is provided in a surface 10*a* of the driver housing 10. Preferably, the pluggable module 40 has a housing 43 cooperating with the driver housing 10 such that the outside surfaces 44 and 10*a* are flush with each other when the pluggable module 40 is installed. Further, the driver housing 10 is provided with input connector elements 11, 12 for connection to a power supply, e.g. the mains, with output connector elements 13, 14 for connection to at least one light source, and with control connector elements 16, 17 for connection to the first or second circuitry 41, 42.

The cross-sectional view of FIG. 3B discloses part of the interior of the driver housing 10. As illustrated in FIG. 3B, the driver circuitry 20 is provided on a circuit board 50 in the driver housing 10. The receiving means 30 comprises a slot 35 provided on the circuit board 50 comprising driver circuitry (not shown) for driving at least one light source. The slot 35 is configured to receive a part of a circuit board 45 with the first and second circuitry 41, 42 of the pluggable module 40. Preferably, the slot 35 comprises contact terminals (not shown in FIGS. 3A and 3B). The circuit board 45 of the pluggable module 40 comprises corresponding contact terminals 46 such that the contact terminals of the slot 35 contact the corresponding contact terminals 46 when the pluggable module 40 is plugged in.

Figure 4:
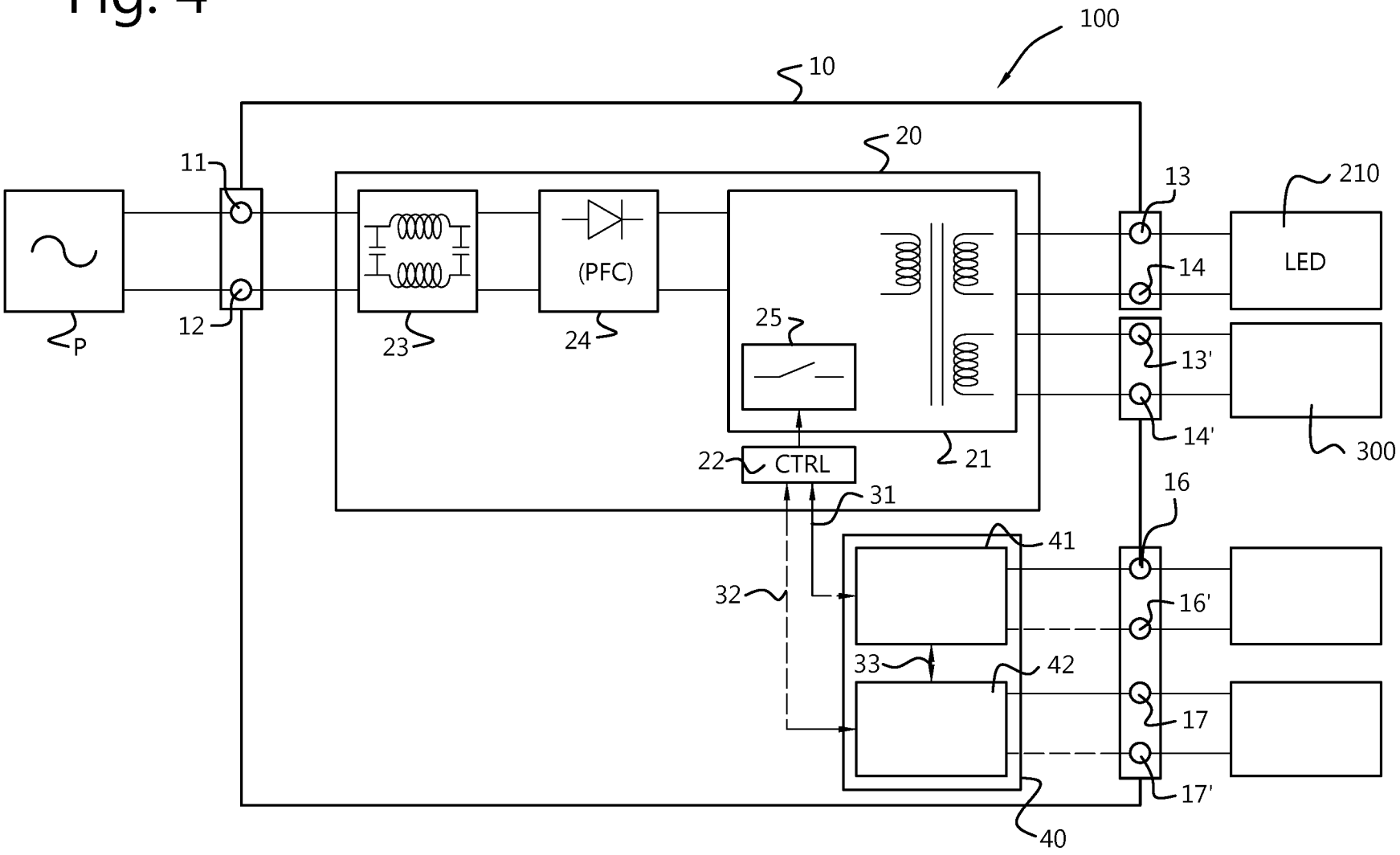
FIG. 4 schematically illustrates another exemplary embodiment of a luminaire driver for driving both at least one light source as well as another device of the luminaire, and a pluggable module plugged in the receiving means thereof.

FIG. 4 illustrates schematically a further developed embodiment of a driver 100 with a driver housing 10 comprising driver circuitry 20. Looking in a downstream direction from the power supply input connector elements 11, 12 towards the output connector elements 13, 14, the driver circuitry 20 comprises a filtering circuitry 23, a rectifier circuitry 24 with optional smoothing and power factor correction circuitry, and a power switching converter circuitry 21. The filtering circuitry 23 may be designed to filter out high frequency noise generated by the power switching converter circuitry 21. It may also include one or more protective components such as a varistor to filter out electrical transients from the grid G. The rectifier circuitry 24 may include one or more components, such as diodes, transistors, capacitors, and/or resistors, arranged to rectify the voltage between the first and second power supply input connector elements 11, 12. The rectifier circuitry 24 may include e.g. a passive diode bridge rectifier. The rectifier circuitry 24 may further include one or more components arranged to smoothen and/or otherwise condition the rectified DC voltage, and/or a passive component, such as inductor and capacitor, to perform a power factor correction. The power switching converter circuitry 21 includes a transformer with at least one primary side winding and at least one secondary side winding, preferably with a galvanic insulation between the primary side and the secondary side. The isolated power switching converter circuitry 21 may comprise e.g. a flyback converter, a buck converter, a boost converter, etc. The driver circuitry 20 may also comprise control circuitry 22 configured for controlling the converter circuitry 21, and in particular a switching element 25 of the converter circuitry 21, in function of a signal received through the first control connector elements 16, 16' and/or the second control connector elements 17, 17'.

In the embodiment of FIG. 4, the driver circuitry 20 is configured to drive the at least one light source 210, as well as another component 300 of a luminaire, e.g. a controller or a sensing means such as a camera, a light sensor, a particle sensor, a proximity sensor, etc. The driver housing 10 is provided with further output connector elements 13', 14' for connection to the other component 300 of the luminaire. The converter circuitry 21 may comprise voltage-to-current converter circuitry configured for generating a drive current for the at least one light source 210, as well as other converter circuitry configured for generating a drive current or voltage suitable for driving the other component 300, e.g. a sensor, a camera, a controller, etc. The receiving means may be configured such that the first circuitry 41 and/or the second circuitry 42 are directly or indirectly connected to the control circuitry 22 in order to control one or more switching elements 25 of the converter circuitry 21. Depending on the number of output signals on output connector elements 13, 14 and/or 13', 14', that need to be controlled, a suitable number of switching elements 25 may be provided. In that manner one or more output signals on output connectors 13-14 and/or 13'-14' may be controlled in function of one or more control inputs received through connector elements 16 and/or 17.

Figure 5:
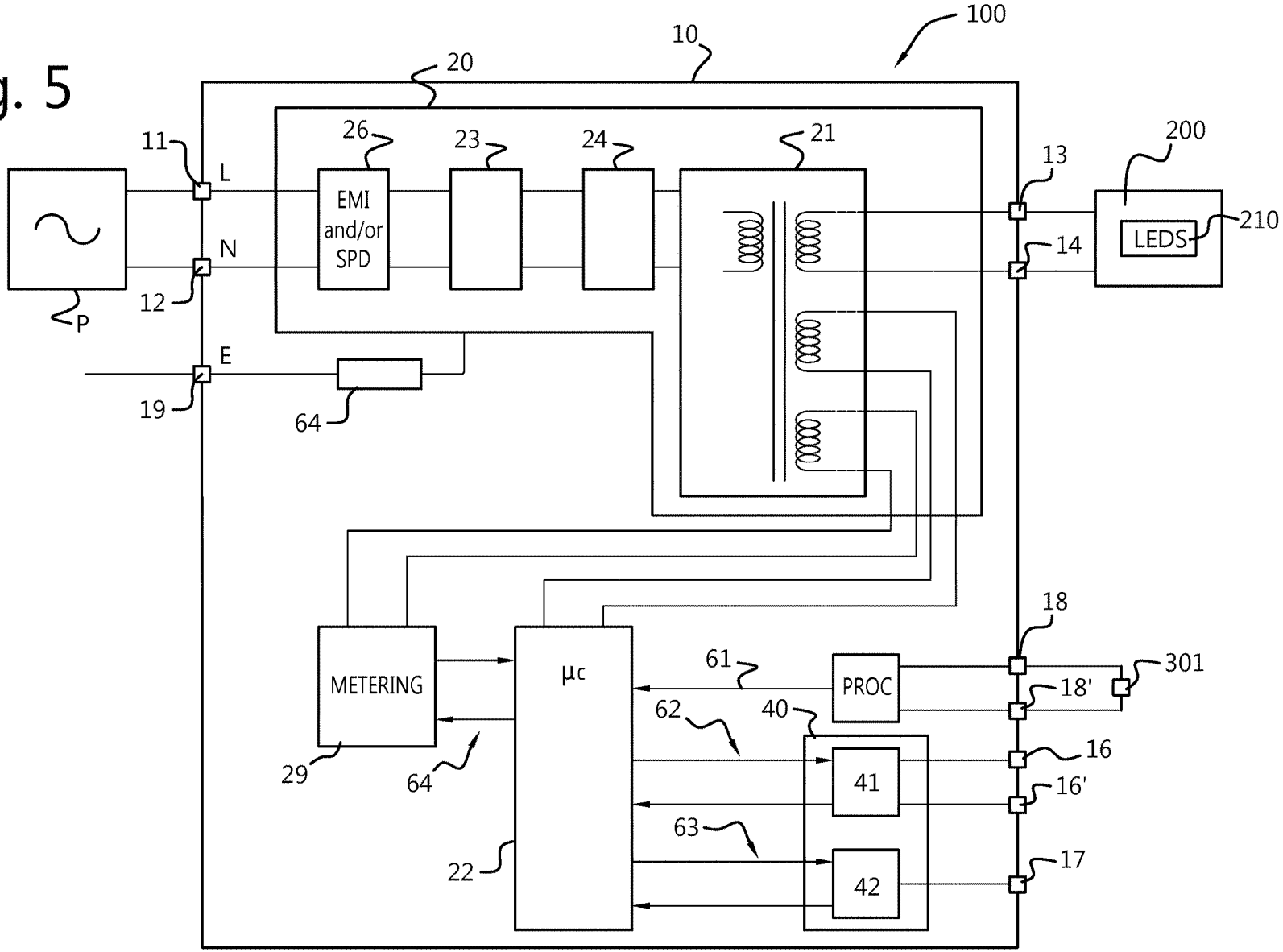
FIG. 5 schematically illustrates a more detailed exemplary embodiment of a luminaire driver.

FIG. 5 illustrates schematically a more detailed exemplary embodiment of a luminaire driver 100 with a driver housing 10 comprising driver circuitry 20. Looking in a downstream direction from the power supply input connector elements 11, 12 towards the output connector elements 13, 14, the driver circuitry 20 comprises a surge protection and/or EMI protection circuitry 26, a rectifying and/or filtering circuitry 23, a rectifying and/or power factor correction circuitry 24, and a power switching converter circuitry 21. Optionally the driver housing 10 may be provided with an equipotential connector E which is connected through resistive circuitry 64 to the driver circuitry to provide ESD protection. This is described in detail in patent application PCT/EP2019/075119 in the name of the applicant, which is included herein by reference. The power switching converter circuitry 21 includes a transformer with at least one primary side winding and at least one secondary side winding, preferably with a galvanic insulation between the primary side and the secondary side. The isolated power switching converter circuitry 21 may comprise e.g. a flyback converter, a buck converter, a boost converter, etc. The driver circuitry 20 may also comprise a microcontroller 22 configured for controlling the converter circuitry 21, in function of e.g. a signal received through one or more first control connector elements 16, 16' and/or one or more second control connector elements 17 and/or in function of a signal sensed by a sensor 301, e.g. a temperature sensor, see further. To that end, the driver housing 10 is provided with further input connector elements 18, 18' for connection to an external sensor 301 arranged outside of the driver housing 10. The input connector elements 18, 18' may be connected to a processing means 28 arranged inside the driver housing 10 for processing the signals sensed by the external sensor 301 and for outputting a control signal to the microcontroller 22, see arrow 61. Optionally, the operation of the external sensor 301 may also be controlled by the microcontroller 22 (not shown).

In the embodiment of FIG. 5, the driver circuitry 20 is configured to drive the at least one light source 210 through output connector elements 13, 14, to drive an external component 300 of a luminaire through output connector elements 13', 14', e.g. a controller or a sensing means such as a camera, a light sensor, a particle sensor, a proximity sensor, etc., arranged outside the driver housing 10, and to drive one or more internal components, here the microcontroller 22 and a metering device 29. The converter circuitry 21 of the driver circuitry 20 may comprise voltage-to-current converter circuitry configured for generating a drive current for the at least one light source 210, as well as other converter circuitry configured for generating a drive current or voltage suitable for driving one or more external components 300, and/or one or more internal components such as microcontroller 22 and metering device 29.

The driver housing 10 is provided with a receiving means of a pluggable module 40. The pluggable module 40 comprises a first circuitry 41 associated with a first protocol and a second circuitry 42 associated with a second protocol, said second protocol being different from said first protocol. The pluggable module 40 may be configured such that the first circuitry 41 and/or the second circuitry 42 are directly or indirectly connected to the microcontroller 22 e.g. in order to control the converter circuitry 21. In that manner one or more output signals on output connector elements 13, 14 and/or 13', 14' may be controlled in function of one or more control inputs received through control connector elements 16, 17 and/or in function of one or more sensed signals received through connector elements 18, 18'. It is noted that having a signal/data on the first or second circuitry 41 or 42 that has the goal to control the converter circuitry 21 is not mandatory. In another embodiment signals and/or data captured through the first circuitry 41 may be processed and/or converted in the microcontroller 22 to generate another set of signals and/or data which is provided to the second circuitry 42.

The first protocol may be e.g. DALI, or 1-10V, or 0-10V, and the second protocol may be a communication protocol e.g. the Universal Asynchronous Transmitter Receiver (UART) or RS232 or RSZ485 or $I^2C$ or SPI protocol. In that manner communication protocol signals can be exchanged between the input connector elements 16, 16' and the microcontroller 22 through the first circuitry 41, see arrows 62 and dimming protocol signals (e.g. DALI, or 1-10V, or 0-10V) may be exchanged between one or more input connector elements 17 and the microcontroller 22 through the second circuitry 42, see arrows 63. The luminaire driver 100 may further comprise internal circuitry (not shown) configured to recognize the presence and/or the type of the pluggable module 40 when the pluggable module 40 is plugged-in in the receiving means. In such case, the luminaire driver 100 may further comprise signal switching and/or signal adaption circuitry (not shown) between the first and second circuitry 41, 42 and the driver circuitry 20, e.g. in the microcontroller 22, and/or between the one or more first and second control connector elements 16, 16', 17 and the first and second circuitry 41, 42. The internal circuitry may be configured to set the signal switching and/or signal adaption circuitry in function of the recognized type of pluggable module 40. For example, when it is detected that the first circuitry 41 is associated with a 0-10V protocol, then the microcontroller 22 may use a pulse width modulation (PWM) circuitry to drive a PWM signal on line 62, while if the first circuitry 41 is associated with an RS232 protocol then the microcontroller 22 may use embedded UART circuitry to drive in/out signals on lines 62.

Whilst the principles of the invention have been set out above in connection with specific embodiments, it is to be understood that this description is merely made by way of example and not as a limitation of the scope of protection which is determined by the appended claims.

The invention claimed is:

1. A luminaire driver comprising:

a driver housing provided with input connector elements for connection to a power supply and output connector elements for connection to at least one light source, said input connector elements and output connector elements being accessible from outside of the driver housing;

a driver circuitry arranged in said driver housing between said input connector elements and said output connector elements, and configured to perform a driving function of the at least one light source; and a receiving means configured for receiving at least one pluggable module, said at least one pluggable module comprising a first circuitry associated with a first protocol and a second circuitry associated with a second protocol, said second protocol being different from said first protocol, wherein the receiving means is configured such that the at least one pluggable module can be received from outside of the driver housing, wherein at least one of the first circuitry and the second circuitry is connected to the driver circuitry when the at least one pluggable module is plugged in the receiving means, wherein the driver housing is provided with at least one first and second control connector element, which are connected to the first and second circuitry, respectively, when the at least one pluggable module is plugged in the receiving means, and wherein the at least one first and second control connector element are arranged such that they are accessible by a user from outside of the driver housing, further comprising internal circuitry configured to recognize the presence and/or the type of the at least one pluggable module when the at least one pluggable module is plugged-in in the receiving means.

2. The luminaire driver according to claim 1, wherein the first and the second circuitry are included in a single pluggable module.

3. The luminaire driver according to claim 1, wherein the receiving means is at least partly situated in the driver housing and/or is part of the driver housing, wherein preferably the receiving means and the at least one pluggable module are configured such that the at least one pluggable module is removable.

4. The luminaire driver according to claim 1, wherein the driver housing is provided with a recess for receiving the at least one pluggable module, said recess forming a portion of the receiving means.

5. The luminaire driver according to claim 1, wherein the at least one first and second control connector element comprises at least a first input control connector element, a first output control connector element, and a second input and/or output control connector element.

6. The luminaire driver according to claim 1, wherein the driver circuitry is provided on a circuit board in the driver housing, wherein preferably the receiving means comprises a slot provided on the circuit board, said slot being configured to receive a part of a circuit board with the first and second circuitry of the at least one pluggable module.

7. The luminaire driver according to claim 6, wherein the recess is provided in a surface of the driver housing opposite the slot.

8. The luminaire driver according to claim 1, wherein the driver circuitry comprises converter circuitry, preferably voltage-to-current converter circuitry configured for generating a drive current for the at least one light source, wherein preferably the driver circuitry comprises control circuitry configured for controlling the converter circuitry in function of a signal received through the first and/or second control connector element.

9. The luminaire driver according to claim 8, wherein the receiving means and the control circuitry are configured such that the converter circuitry can be controlled independently by a first signal received through the first control connector element and by a second signal received through the second control connector element.

10. The luminaire driver according to claim 1, further comprising signal switching and/or signal adaption circuitry, wherein the internal circuitry is configured to set the signal switching and/or signal adaption circuitry in function of the recognized type.

11. The luminaire driver according to claim 1, wherein the first circuitry is configured to perform a dimming control function for dimming the at least one light source, and wherein the second circuitry is configured to perform a communication function.

12. The luminaire driver according to claim 1, wherein the first and/or second protocol comprises: CAN, DALI, UART, 1-10V, 0-10V, I2C, RS485, ENOCEAN, Bluetooth Low Energy (BLE), ZigBee control, NFC (Near Field Communication), Low-Power Wide-Area Network (LPWAN), Sigfox, Narrow-Band Internet of Things (NB-IoT), or LoRaWAN.

13. The luminaire driver according to claim 1, wherein the receiving means comprises a mechanical means comprising a biunique fitting mechanism configured to hold the at least one pluggable module.

14. The luminaire driver according to claim 1, wherein the driver housing is provided with further output connector elements for connection to a luminaire device, and wherein the driver circuitry is further configured for driving said luminaire device.

15. The luminaire driver according to claim 1, wherein the input connector elements and/or the output connector elements and/or the first and second control connector element are any one of the following: a connection wire, a connector plug, a connector pin, a connector socket, a terminal block, or any combination thereof.

16. The luminaire driver according to claim 1, comprising at least one pluggable module plugged in the receiving means.

17. The luminaire driver according to claim 1, wherein the first and/or second circuitry comprises any one or more of the following: digital signal processing circuitry, sensor control circuitry, preferably any one of the following: IR camera daylight sensing circuitry, motion sensor and video/image processing circuitry, air quality sensing circuitry, sound sensing circuitry.

18. A luminaire comprising the luminaire driver according to claim 1.

19. A use of a pluggable module in the luminaire according to claim 18.

20. A pluggable module configured for use in the luminaire driver according to claim 1, said pluggable module comprising a first circuitry associated with a first protocol and second circuitry associated with a second protocol, said second protocol being different from said first protocol.

21. A use of a pluggable module in the luminaire driver according to claim 1.

* * * * *